US006612229B2

(12) United States Patent
Hofele et al.

(10) Patent No.: US 6,612,229 B2
(45) Date of Patent: Sep. 2, 2003

(54) MULTISTATION PRESS

(75) Inventors: Hans Hofele, Göppingen (DE); Jürgen Hohnhaus, Wäschenbeuren (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 10/025,984

(22) Filed: Dec. 26, 2001

(65) Prior Publication Data

US 2002/0088266 A1 Jul. 11, 2002

(30) Foreign Application Priority Data

Dec. 22, 2000 (DE) ..... 100 64 154

(51) Int. Cl.[7] ..... B21J 11/00
(52) U.S. Cl. ..... 100/207; 72/405.1; 72/405.01
(58) Field of Search ..... 100/214, 207, 100/140, 208; 72/405.1, 405.01, 405.14, 405.11, 405.15, 405.16

(56) References Cited

U.S. PATENT DOCUMENTS

| | | | | |
|---|---|---|---|---|
| 4,589,819 A | | 5/1986 | Shirao | |
| 5,727,416 A | * | 3/1998 | Allgoewer | 72/405.11 |
| 5,842,370 A | * | 12/1998 | Hofele et al. | 72/405.09 |
| 5,894,790 A | * | 4/1999 | Viaud | 100/5 |
| 5,899,108 A | * | 5/1999 | Hofele et al. | 72/405.1 |

FOREIGN PATENT DOCUMENTS

| | | | |
|---|---|---|---|
| DE | 4418417 | | 11/1995 |
| EP | 0658403 | | 10/1997 |
| JP | 3221228 | * | 9/1991 |
| JP | 4220124 | * | 5/1992 |
| JP | 5177277 | * | 7/1993 |

* cited by examiner

*Primary Examiner*—Allen Ostrager
*Assistant Examiner*—Shelley Self
(74) *Attorney, Agent, or Firm*—Crowell & Moring LLP

(57) ABSTRACT

A multistation press has several slides which can be moved up and down and which are equipped with tools for forming workpieces. The press a transport arrangement for transporting the workpieces within and/or between the stations. At least one cross traverse for holding the workpieces, in its resting condition, is aligned at least approximately perpendicularly with respect to the transport direction of the workpieces. The cross traverse is held at its two ends in each case a lever arrangement and can be oriented in the space. A length compensating device is arranged on at least one of the two ends of the cross traverse to change the overall length of the cross traverse between its two ends. The length compensating device has an exterior tube element, which is mounted at one end of the cross traverse on the one lever arrangement, and an interior element which is displaceably arranged inside the exterior tube element and which is mounted at the other end of the cross traverse on the other lever arrangement.

15 Claims, 2 Drawing Sheets

MULTISTATION PRESS

BACKGROUND OF THE INVENTION

This application claims the priority of Germany, filed Dec. 22, 2000, the disclosure of which is expressly incorporated by reference herein.

The present invention relates to a multistation press having several slides which can be moved up and down and which are equipped with tools for forming workpieces, and a transport arrangement for transporting the workpieces between the stations.

DE 44 18 417 A1 describes a transfer arrangement in a forming machine, in which a cross traverse mutually connects two mutually opposed carriages which can be moved on rails. In order to permit that one carriage runs ahead of the other carriage in the transport direction, the cross traverse is equipped with a length compensation device.

A multistation press having a transport arrangement for transporting workpieces which has several cross traverses is also described in WO 96/26025. In that case, each cross traverse consists of two parallel rails that requires very high control-related expenditures for a slidable holding device for workpieces which is mounted thereon.

SUMMARY OF THE INVENTION

An object of the present invention is to further improve a multistation press having a transport arrangement such that the alignment of the workpieces to be transported is ensured in any arbitrary orientation in the space while the operating mode is simultaneously reliable.

According to the invention, this object is achieved by a multistation press in which the two ends of the cross traverse are connected by way of cardan joints with the respective lever arrangements.

As a result of the length compensation device according to the invention, with the tube element mounted on one lever arrangement and the interior element mounted on the other lever arrangement, the cross traverse can be oriented in any direction in the space without causing high control-related expenditures. The interior element moves with respect to the tube element and thus compensates differences between the position of the lever arrangement at one end of the cross traverse and the lever arrangement at the other end of the cross traverse.

A very good mobility of the cross traverse with respect to the two lever arrangements and thus a simple three-dimensional movability of the latter can be achieved if, as an advantageous further development of the invention, the two ends of the cross traverse can be connected with the respective lever arrangements by way of cardan joints.

In order to be able to compensate also possible rotating motions within the cross traverse, of the present invention may also provide that the interior element has an at least approximately round cross-section, and that the exterior tube element has a bore which has an at least approximately round cross-section and in which the interior element is accommodated.

Two or more holding devices for holding the workpieces, which holding devices can be moved independently of one another in a freely programmable manner along the cross traverse, ensure that two workpieces can be transported simultaneously and in the process can be moved independently of one another. This independent movement of the two workpieces can be used, for example, when, because of a cutting, two workpieces are created from one workpiece, the two workpieces being movable away from one another. As a result, intermediate depositing devices, which so far have been used for displacing the two workpieces, can be eliminated.

Thereby, the present invention makes possible to also, with an eccentric arrangement, to still grip workpieces such that the center of gravity of the workpiece is situated in the center of the at least two holding devices. Particularly in the case of a cross traverse, which can be moved in a space in an arbitrary manner, this is a great advantage because eccentric arrangements of the workpieces are frequently necessary particularly in such cases.

A simple possibility of independently moving the at least two holding devices can occur when the at least two holding devices can each be displaced by way of linear drives along the cross traverse.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
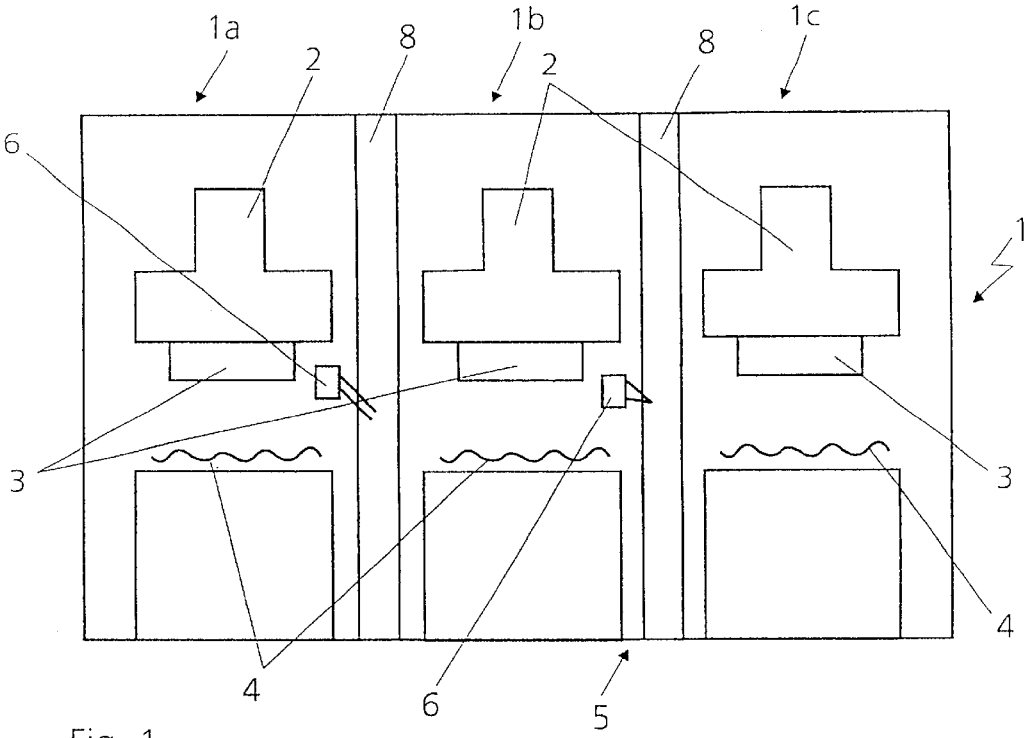
FIG. 1 is a schematic elevational view of a multistation press according to the invention with a transport arrangement which has several cross traverses.

FIG. 1 shows one embodiment of a multistation press 1 which has three individual stations 1*a*, 1*b* and 1*c* as well as three slides 2 which can be moved up and down and on which tools 3 are mounted for forming workpieces 4. The workpieces 4 are transported by a transport arrangement within the individual stations 1*a*, 1*b* and 1*c*.

For this transport purpose, the transport arrangement 5 in the present case has two cross traverses 6 for holding the workpieces which are arranged between stations 1*a*, 1*b* as well as between stations 1*b*, 1*c* and which, in their illustrated resting position, are aligned approximately perpendicularly with respect to the transport direction of the workpieces 4 which is indicated by an arrow "T". The construction of the cross traverses 6 will be described in greater detail with reference to FIGS. 2, 3 and 4.

Figure 2:
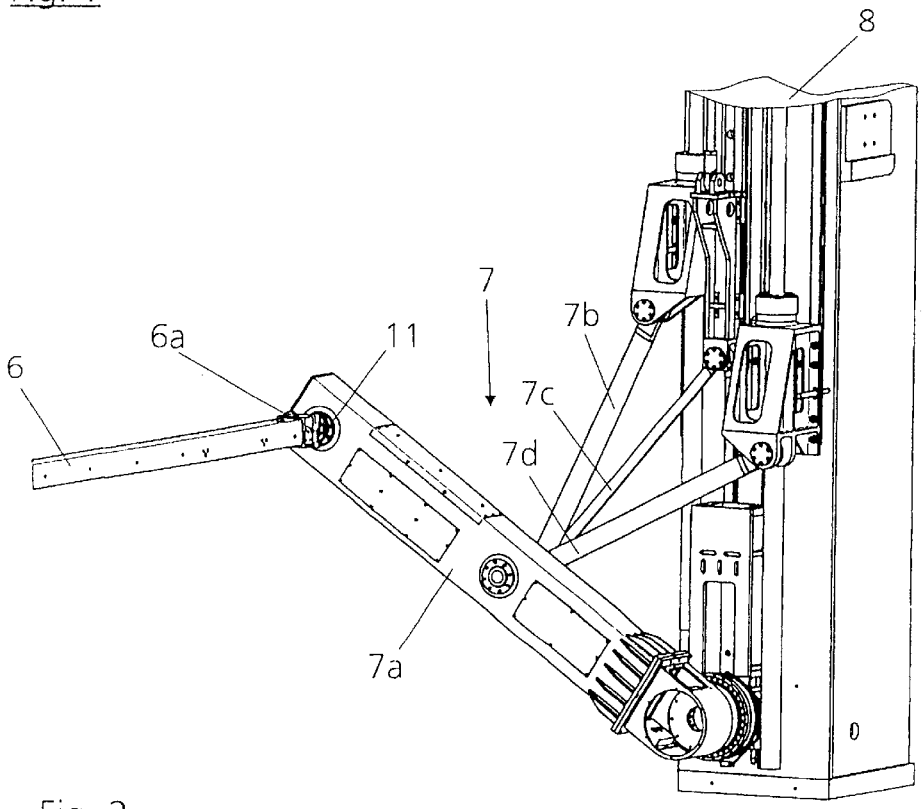
FIG. 2 is a perspective isolated view of a cross traverse arranged by way of a lever arrangement on a perpendicular guiding element of the transport arrangement.

The cross traverse 6 is in each case mounted by way of a lever arrangement 7 at both of its ends 6*a* and 6*b* on a perpendicularly extending guiding element 8 as a part of the transport arrangement 5. For case of illustration and understanding, only the end 6*a* of the cross traverse 6 and therefore also only its mounting to the guiding element 8 are illustrated in FIG. 2, the other end having identical construction. By way of the lever arrangement 7, the cross traverse 6 can be arbitrarily oriented in the space, particularly with respect to different heights of the two ends 6*a,* 6*b*. For this purpose, the lever arrangement 7 has a main lever 7*a* which is rotatably disposed with respect to the perpendicular guiding element 8 and is held by way of three driving or connection levers 7*b,* 7*c,* and 7*d* on the guiding element 8. Of course, an identical or mirror-inverted lever arrangement 7 is situated on the opposite end 6*b* of the cross traverse 6 as above noted, so that the cross traverse 6, which is rotatable with respect to the main lever 7*a,* can be oriented approximately arbitrarily in the space.

Figure 3:
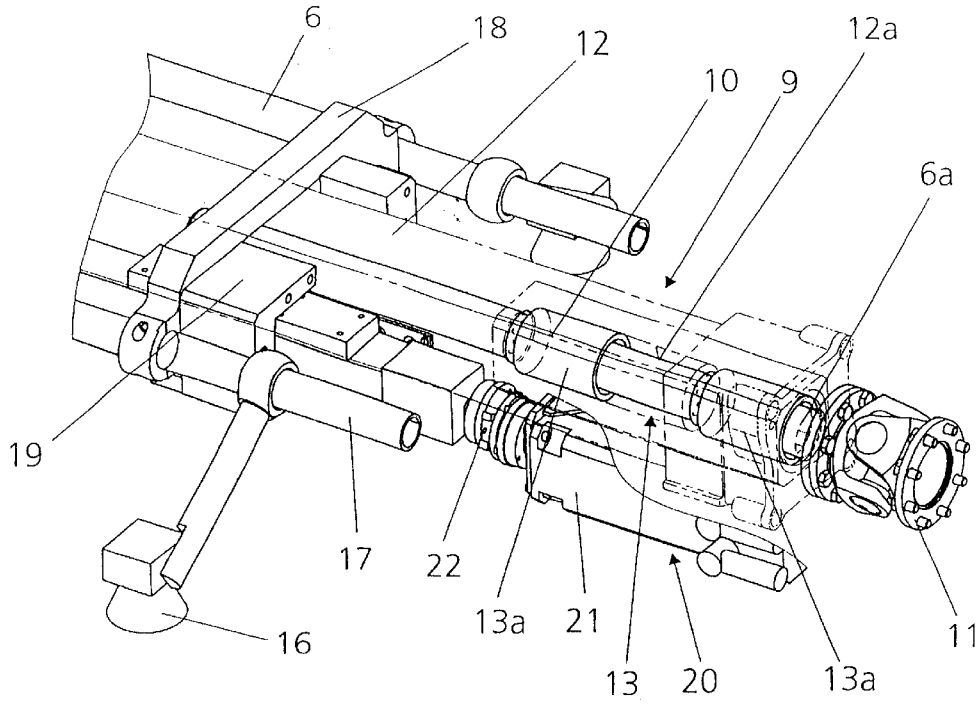
FIG. 3 is a perspective isolated view of a length compensating device for the cross traverse of FIG. 2.

In order to permit this arbitrary orientation in the space without any problems, a length compensating device 9 illustrated in detail in FIG. 3 is arranged at the end 6*a* of the cross traverse. The length compensating device 9 permits the changing of the overall length of the cross traverse 6 between the two ends 6*a*, 6*b*. For this purpose, the length compensating device 9 has an interior element 10 which is mounted at the end 6*a* of the cross traverse 6 and which is connected by way of a cardan joint 11 with the main lever 7*a*. The cardan joint 11 permits the cross transverse 6 to take up arbitrary angular positions. Outside the interior element 10, a tube element 12 which, in a manner not shown in detail, is also mounted by a cardan joint 11 visible in FIG. 4 at the other end 6*b* on the lever arrangement 7. In other words, the interior element 10, which has a round cross-section, is accommodated inside the tube element 12, specifically in an also round bore 12*a*. The interior element 10 is displaceable with respect to the tube element 12, whereby the overall length of the cross traverse 6 can be changed.

In order to be able to absorb shocks and ensure a sliding movement with low friction losses, the interior element 10 is disposed with respect to the exterior tube element 12 by way of a bearing device 13 having two radial bearings 13*a*. The two radial bearings 13*a* are situated inside the bore 12*a*. As a result of the round construction of the interior element 10 and of the bore 12*a*, the two elements 10, 12 can be rotated with respect to one another.

Figure 4:
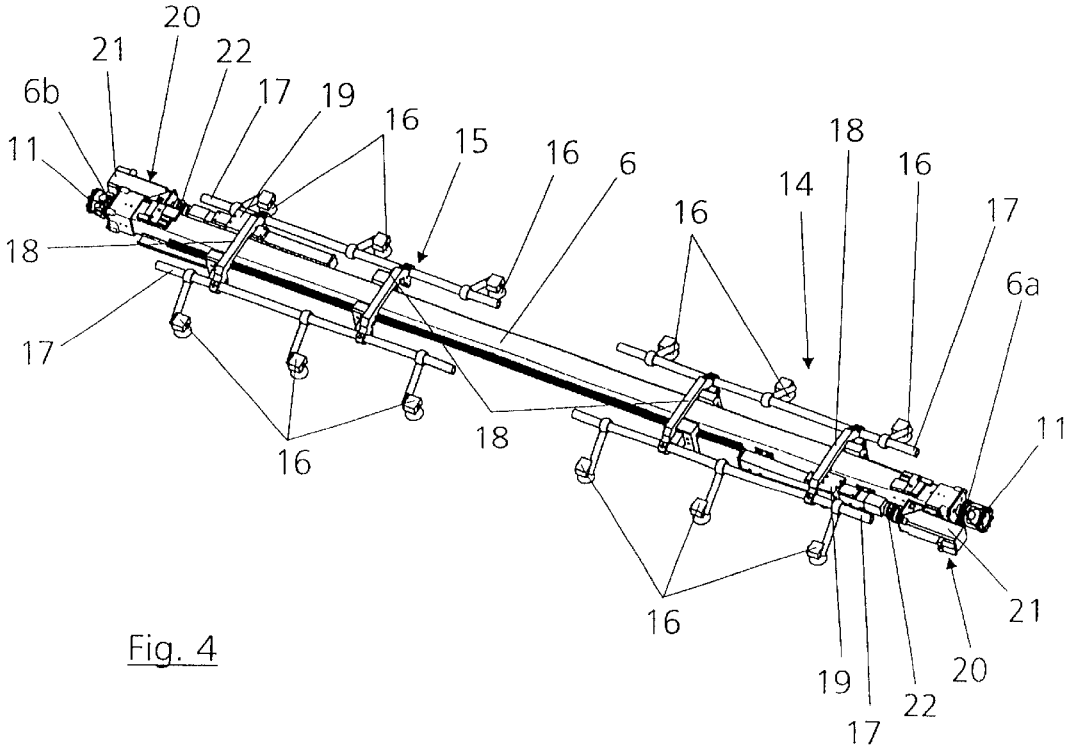
FIG. 4 is a perspective view of a cross traverse having two holding devices for workpieces.

FIG. 4 shows the entire cross traverse 6 including two holding devices 14, 15 which are provided for holding the workpieces 4 which are not illustrated in this figure. The holding devices 14, 15 can be moved independently of one another in a freely programmable manner along the cross traverse 6, whereby it becomes possible to move two workpieces 4 independently of one another and relative to one another by way of the cross traverse 6. As a result, previously required intermediate depositing devices can be eliminated. In certain applications, a larger number of holding devices 14, 15 respectively can be provided on a cross traverse 6.

Each of the holding devices 14, 15 has several suction elements 16 which establish the actual connection to the workpiece or workpieces 4. In the illustrated embodiment, three suction elements respectively 16 are mounted on a connection rod 17 extending along the cross traverse 6. Two connection rods 17 per holding device 14, 15, respectively, are connected with one another by two saddles 18 which are arranged on carriages 19 and thus movable along the cross traverse 6.

The carriages 19 can each be displaced by linear drives 20 along the cross traverse 6, in which each of the linear drives 20 has an electric motor 21 and a spindle (not shown) which is applied directly to the respective carriage 19 and is connected with the electric motor 21 by a coupling 22. If a workpiece 4 is to be transported jointly by both holding devices 14, 15, the latter or their linear drives 20 are electronically synchronized.

The two holding devices 14, 15 or the associated saddles 18 with the connection rods 17 mounted thereon and the pertaining suction elements 16 can be automatically exchanged in a manner so that different workpieces 4 can be transported. For this purpose, the saddles 18 are lifted off the carriage 19, for which the movement of the cross traverse 6 and that of the carriages 19 can be utilized.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Multistatioin press, comprising a plurality of slides which are movable up and down and equipped with tools for forming workpieces, and a transport arrangement for transporting the workpieces at least one of within and between the stations, wherein the transport arrangement includes at least one cross traverse for holding the workpieces which, in a resting condition thereof, is aligned at least approximately perpendicularly with respect to a transport direction of the workpieces, the at least one cross traverse being held at two ends thereof by a lever arrangement so as to be orientable in a desired space including directions skewed to the transport direction as viewed in horizontal and vertical planes, a length compensating device being arranged on at least one of the two ends of each of the at least one cross traverse to change the overall length of the at least one cross traverse between the two ends thereof, and the length compensating device having an exterior tube element mountable at one end of the at least one cross traverse on the one lever arrangement, and an interior element displaceably arrangeable inside the exterior tube element mountable at the other end of the at least one cross traverse on the other lever arrangement.

2. Multistation press according to claim 1, wherein the two ends of the cross traverse are operatively connectable by with the respective lever arrangements by cardan joints.

3. Multistation press according to claim 1, wherein the interior element is disposed with respect to the exterior tube element in a bearing device.

4. Multistation press according to claim 3, wherein the bearing device has two radial bearings.

5. Multistation press according to claim 1, wherein the interior element has an at least approximately round cross-section, and the exterior tube element has a bore with an at least approximately round cross section, in which bore the interior element is housable.

6. Multistation press according to claim 5, wherein the two ends of the cross traverse are operatively connectable by with the respective lever arrangements by cardan joints.

7. Multistation press according to claim 6, wherein the interior element is disposed with respect to the exterior tube element in a bearing device.

8. Multistation press according to claim 7, wherein the bearing device has two radial bearings.

9. Multistation press, comprising a plurality of slides which are movable up and down and are equipped with tools for forming workpieces, and a transport arrangement for transporting the workpieces at least one of within and between the stations, wherein the transport arrangement includes at least one cross traverse for holding the workpieces which, in a resting condition thereof, is aligned at least approximately perpendicularly with respect to a transport direction of the workpieces, the at least one cross traverse is operatively held at two ends thereof by a lever arrangement and is orientable in a desired space, at least two holding devices for holding the workpieces are arranged on each of the at least one cross traverse, and the at least two holding devices are movable independently of one another in a freely programmable manner along each of the at least one cross traverse.

10. Multistation press according to claim 9, wherein the at least two holding devices each have suction elements for holding the workpieces.

11. Multistation press according to claim 9, wherein the at least two holding devices are each displaceable by linear drives along the at least one cross traverse.

12. Multistation press according to claim 11, wherein the at least two holding devices each have suction elements for holding the workpieces.

13. Multistation press according to claim 11, wherein each of the linear drives has an electric motor operative connected to a respective holding device for driving the respective holding device.

14. Multistation press according to claim 9, wherein the at least two holding devices are electronically synchronized during the joint transport of a workpiece.

15. Multistation press according to claim 9, wherein the at least two holding devices are automatically exchangeable.

* * * * *